US006941679B1

(12) United States Patent
Harris et al.

(10) Patent No.: US 6,941,679 B1
(45) Date of Patent: Sep. 13, 2005

(54) LAUNDRY MACHINE WITH MALFUNCTION DETECTION SYSTEMS

(75) Inventors: Stephen L. Harris, Oshkosh, WI (US); Andrew Kegler, Ripon, WI (US); Lon Borgmann, Oshkosh, WI (US); Thomas F. L'Esperance, Oshkosh, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 0 days.

(21) Appl. No.: 10/875,002

(22) Filed: Jun. 22, 2004

(51) Int. Cl.[7] ..... F26B 17/00

(52) U.S. Cl. ..... 34/596; 34/599; 34/601; 34/602

(58) Field of Search ..... 34/544, 596, 599, 34/601, 602, 603; 68/12.06, 12.14

(56) References Cited

U.S. PATENT DOCUMENTS 3,186,104 A * 6/1965 Stilwell, Jr. ..... 34/527
3,531,954 A * 10/1970 Krupsky ..... 68/18 F
3,890,719 A * 6/1975 Braga et al. ..... 34/572
4,488,363 A * 12/1984 Jackson et al. ..... 34/572
6,240,586 B1 * 6/2001 Joo ..... 8/159

* cited by examiner

*Primary Examiner*—Stephen Gravini
(74) *Attorney, Agent, or Firm*—Leydig, Voit & Mayer, Ltd.

(57) ABSTRACT

A laundry machine having a malfunction detection system for detecting when an obstructing item protrudes outwardly from a perforated tumbler of the machine beyond a predetermined amount during rotation of the tumbler and for detecting when the drive belt for the tumbler is either broken or dislodged from its drive pulleys. In response to either malfunction, a control device is actuated for automatically shutting down operation of the machine. The obstruction detection system includes a cable disposed in closely spaced relation to an outer perimeter of the tumbler for engagement by an obstructing item extending outwardly from the perforated tumbler beyond the predetermined spacing of the cables. In the illustrated embodiment, the obstruction detection system and the drive belt malfunction detection system utilize a common malfunction detection switch and control circuitry.

18 Claims, 5 Drawing Sheets

LAUNDRY MACHINE WITH MALFUNCTION DETECTION SYSTEMS

FIELD OF THE INVENTION

The present invention relates generally to laundry machines, and more particularly, to malfunction detection systems for laundry machines such as tumbler dryers.

BACKGROUND OF THE INVENTION

If certain malfunctions occur in laundry machines, such as tumbler dryers, which are not promptly detected, excessive damage can occur to the machine and potentially dangerous conditions can arise. Tumbler dryers typically have a belt-driven rotary tumbler basket within which laundered items are tumbled during drying. The tumbler basket is perforated and heated air is directed into the basket from an air inlet to the basket as the items are tumbled and discharged from an outlet side of the basket.

Problems in the operation of tumbler dryers often arise by reason of items left in the pockets of clothes or other garments being laundered. Nails, screws, and other elongated metal items inadvertently left in the pockets of items during laundering can work their way free of the garments during tumbling and migrate to the outer wall of the tumbler basket by reason of centrifugal forces. Such nails and screws quickly find their way through the perforations in the basket with the heads of the fasteners, which are larger than the basket openings, retaining the fasteners in outwardly protruding relation to the basket such that continued rotation of the basket causes the metal fasteners to gauge and damage sheet metal interior panels of the dryer. Fasteners, such as drywall nails, are particularly troublesome since ridges on the shank of the nail tend to prevent dislodgement of the nail from the perforation of the basket even when gauging the interior dryer panels. Such obstructing nails and screws can quickly tear openings into the interior of the dryer which permit ambient air to enter the tumbler from the openings, rather than from the heated air inlet, which in turn can lead to overheating at the inlet of the dryer and the potential for fire.

Potentially hazardous fire conditions also can rapidly arise by reason of a broken or dislodged drive belt for the rotary basket of tumbler dryers. When rotation of the basket is stopped by reason of a break or uncoupling of the drive belt, the high temperature air introduced from the dryer inlet is concentrated on the item or items closest to the air inlet which are no longer being tumbled. Since the dryer often is unattended, a broken or dislodged drive belt can go undetected for some time resulting in overheating and potential ignition of the garments within the dryer.

OBJECTS AND SUMMARY OF THE INVENTION

It is an object of the present invention to provide a laundry machine having an improved malfunction detection system.

Another object is to provide a laundry rotary dryer having an obstruction detection system which will immediately sense and shut down operation of the dryer in the event of an obstruction, such as a nail or screw, protruding through perforations in the tumbler basket beyond a predetermined relatively small distance.

A further object is to provide a laundry dryer having a broken or dislodged drive belt malfunction detection system which will immediately shut down operation of the dryer in the event of breakage or dislodgement of the drive belt for the rotary tumbler basket.

Still another object is to provide a laundry machine having obstruction and drive belt malfunction detection systems of the foregoing type which are relatively simple in design and reliable in operation. A related object is to provide such a laundry machine in which the obstruction and drive belt malfunction detection systems utilize a common sensing switch and control circuitry.

Other objects and advantages of the invention will become apparent upon reading the following detailed description and upon reference to the drawing, in which:

Figure 1:
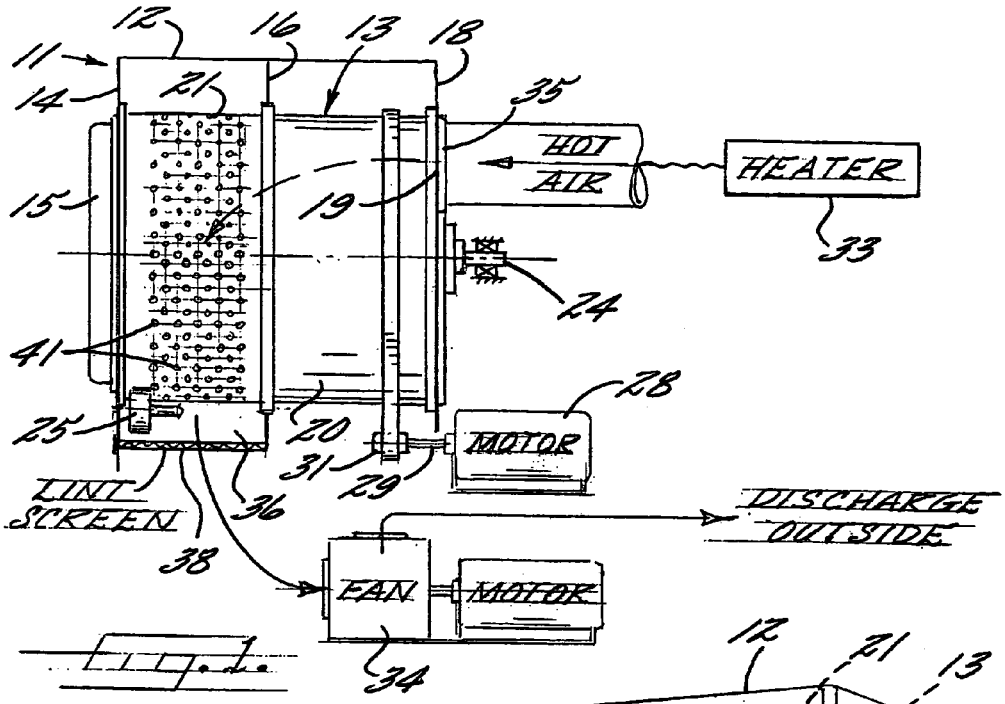
FIG. 1 is a partially diagrammatic side elevational view of a tumbler dryer in accordance with the present invention.
Figure 2:
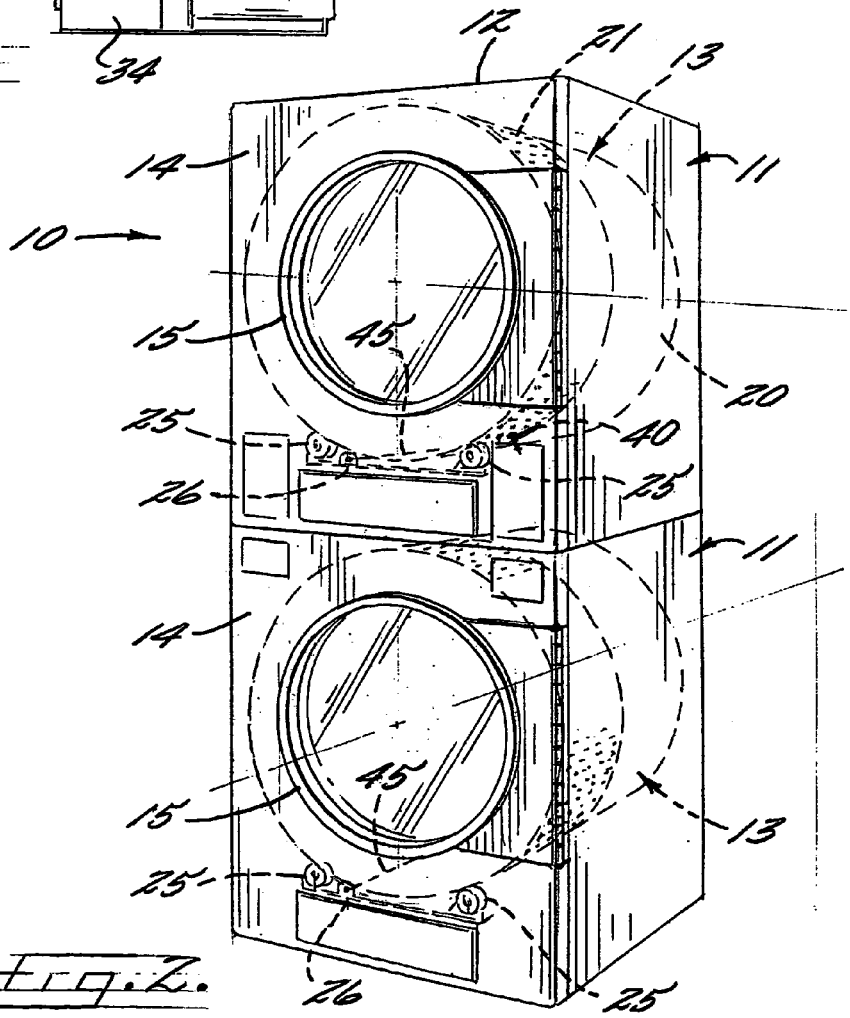
FIG. 2 is a perspective of a laundry machine having a pair of vertically stacked dryers of the type depicted in FIG. 1.
Figure 3:
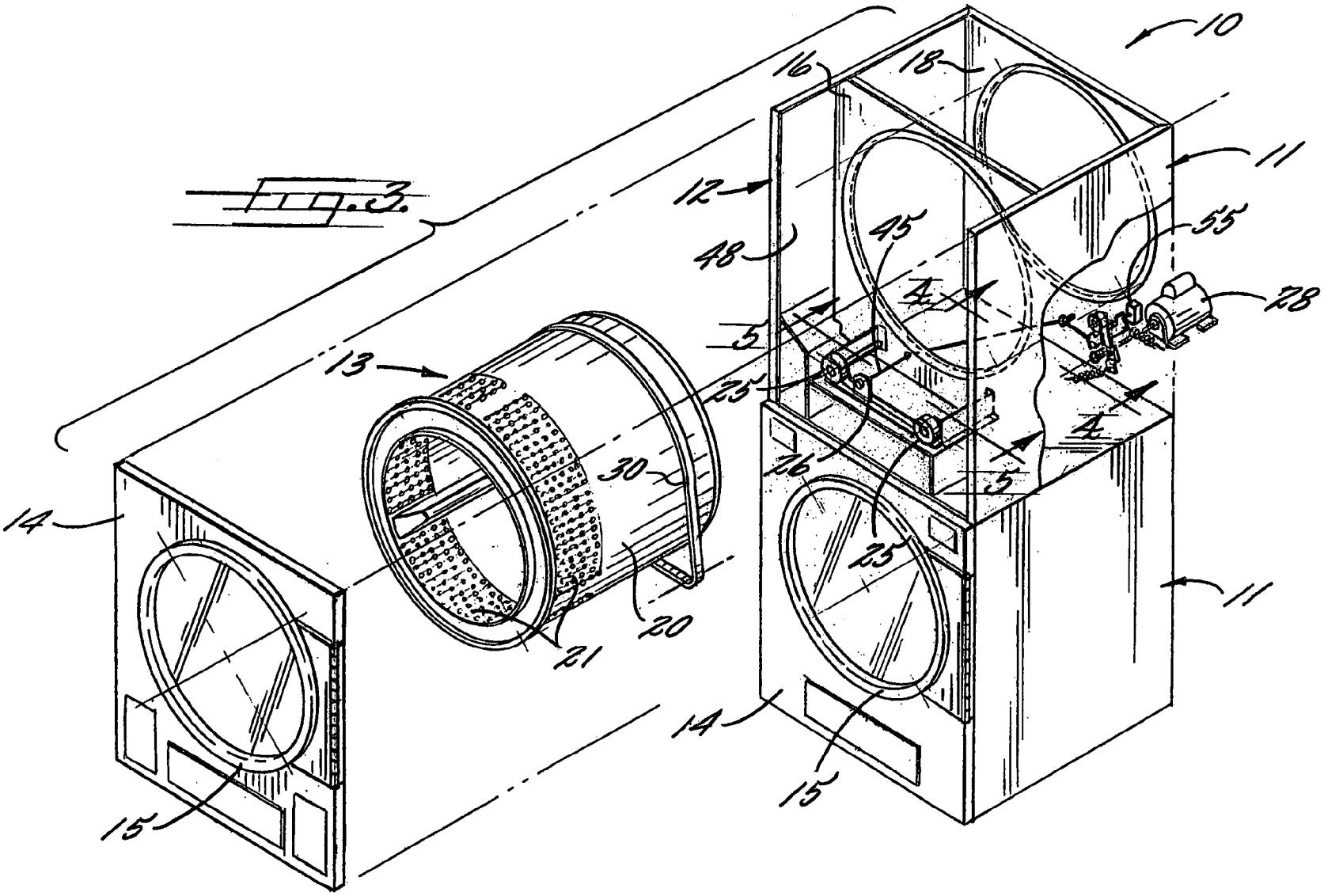
FIG. 3 is a perspective of the laundry machine shown in FIG. 2 with one of the tumbler dryers depicted in exploded fashion.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to the drawings, there is shown an illustrative laundry machine 10 having a malfunction detection system in accordance with the invention. The laundry machine 10 in this case includes a pair of vertically stacked tumbler dryers 11 which basically operate in a conventional manner. Since the dryers are identical in construction and operation, only one need be described in detail.

The illustrated dryer 11 includes a cabinet 12 within which a front opening garment containing tumbler basket 13 is disposed for relative rotational movement. The cabinet 12 includes a front panel 14 adjacent to which a conventional door 15 is mounted, a center panel 16, and a rear panel 18. The tumbler basket 13 has a perforated rear axial end 19 through which heated air is introduced into the tumbler basket 13 in a conventional manner, a rearward unperforated cylindrical portion 20 disposed in sealed relation between the rear panel 18 and the center partition 16, and a forward perforated cylindrical portion 21 disposed between the center partition 16 and the front panel 14. The tumbler basket 13 is supported for rotational movement by a rearwardly extending axle 24 and a pair of rollers 25 mounted in a roller bracket 26 fixed within the cabinet 12 below a front end of the tumbler basket 13.

For rotatably driving the tumbler basket 13, a drive motor 28 with a drive shaft 29 is provided for driving a belt 30. The belt 30 in this instance is trained about a drive shaft pulley 31, the rearward unperforated portion 20 of the tumbler basket 13, and an idler pulley 32. As is known in the art, through operation of a motor driven fan 34, hot air is drawn from a heater 33, which may be either gas or electric powered, disposed on a rear side of the dryer, through an air inlet 35 communicating with the perforated rear axial end 19 of the basket 13, through the basket and out an air outlet 36 communicating with the forward perforated basket portion 21, through a lint filter 38, and then from the fan to the outside environment.

Figure 5:
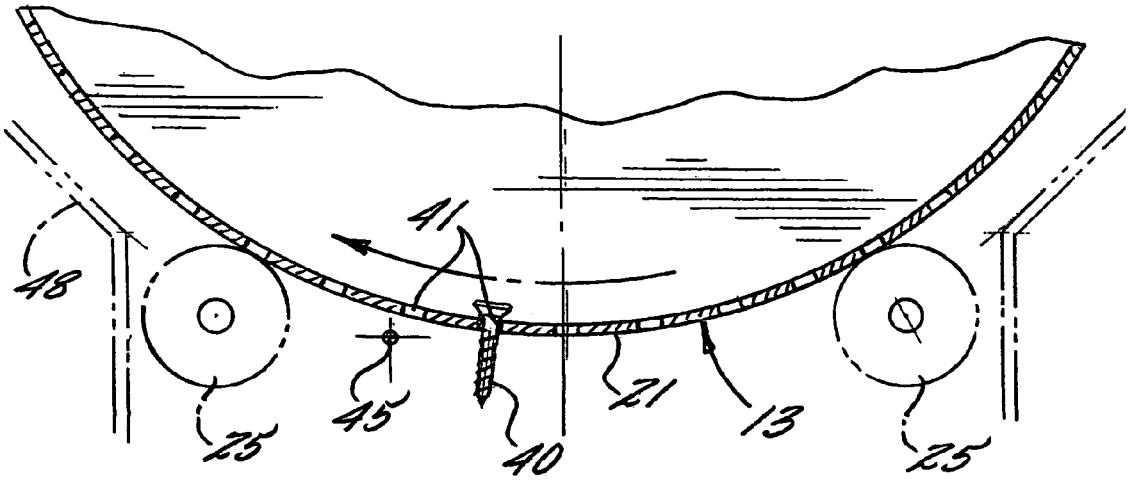
FIG. 5 is an enlarged fragmentary section of the tumbler basket of the illustrated machine, taken in the plane of line 5—5 in FIG. 3, depicting a drywall nail protruding through the basket.

During operation of the dryer 11, heated air is directed into and through the tumbler basket 13 as the basket is rotatably driven by the motor 28 and belt 30, causing laundered items within the basket to be tumbled for enhancing air circulation and drying. As indicated above, items inadvertently left in pockets of the garments being laundered can become loose in the tumbler basket. Items 40, such as screws, nails, and other elongated metal items, can quickly migrate in position such that they extend radially outwardly through apertures 41 in the forward perforated section 21 of the basket, being retained in the perforated basket wall by the heads of the fasteners or the like as depicted in FIG. 5. Due to the rapid rotation of the basket 13 necessary for thorough tumbling of the items being dried, such outwardly extending obstructions can quickly gauge and tear the sheet metal interior walls of the dryer cabinet, not only damaging the dryer but also enabling outside air to enter the basket through the torn opening, thereby interrupting the air flow from the heated air inlet 19 and causing a rapid rise in temperature at the inlet 19 that can quickly create a fire hazard.

In accordance with the invention, an obstruction detection system is provided which will immediately detect obstructions extending from the rotary basket and shut down the dryer before resulting damage can occur. More particularly, an obstruction detection element is provided in closely adjacent relation to an outer perimeter of the perforated cylindrical section of the basket in a manner for engagement by an obstruction, such as a screw or a nail, protruding outwardly of the exterior side of the basket beyond a relatively small distance. In the illustrated embodiment, the obstruction detection element is in the form of a cable 45, such as a stainless steel aircraft type cable, which extends between the guide roller bracket 26 and the center partition 16 of the housing in closely spaced relation to the outer periphery of the perforated basket section 21, such as a radial distance of about 0.25 inches. The cable 45 in this case extends in a direction parallel to the rotary axis of the tumbler basket 13 and is located below the basket at about the seven o'clock position as viewed from the front of the dryer. In other words, the wire is located below the basket on a downstream side of the lowermost point of the basket, as viewed in the clockwise direction of basket rotation. It will be seen that a nail, screw, or like obstructing item 40 extending outwardly through a perforation in the basket beyond the small distance of the cable 45 will engage the cable 45 as the basket rotates. In this instance, the cable 45 is located such that an obstructing item will engage the cable immediately prior to passage upwardly past a left side panel 48 of the dryer cabinet 12, as viewed from the front thereof, which is closely positioned to the side of the tumbler basket 13.

Figure 4:
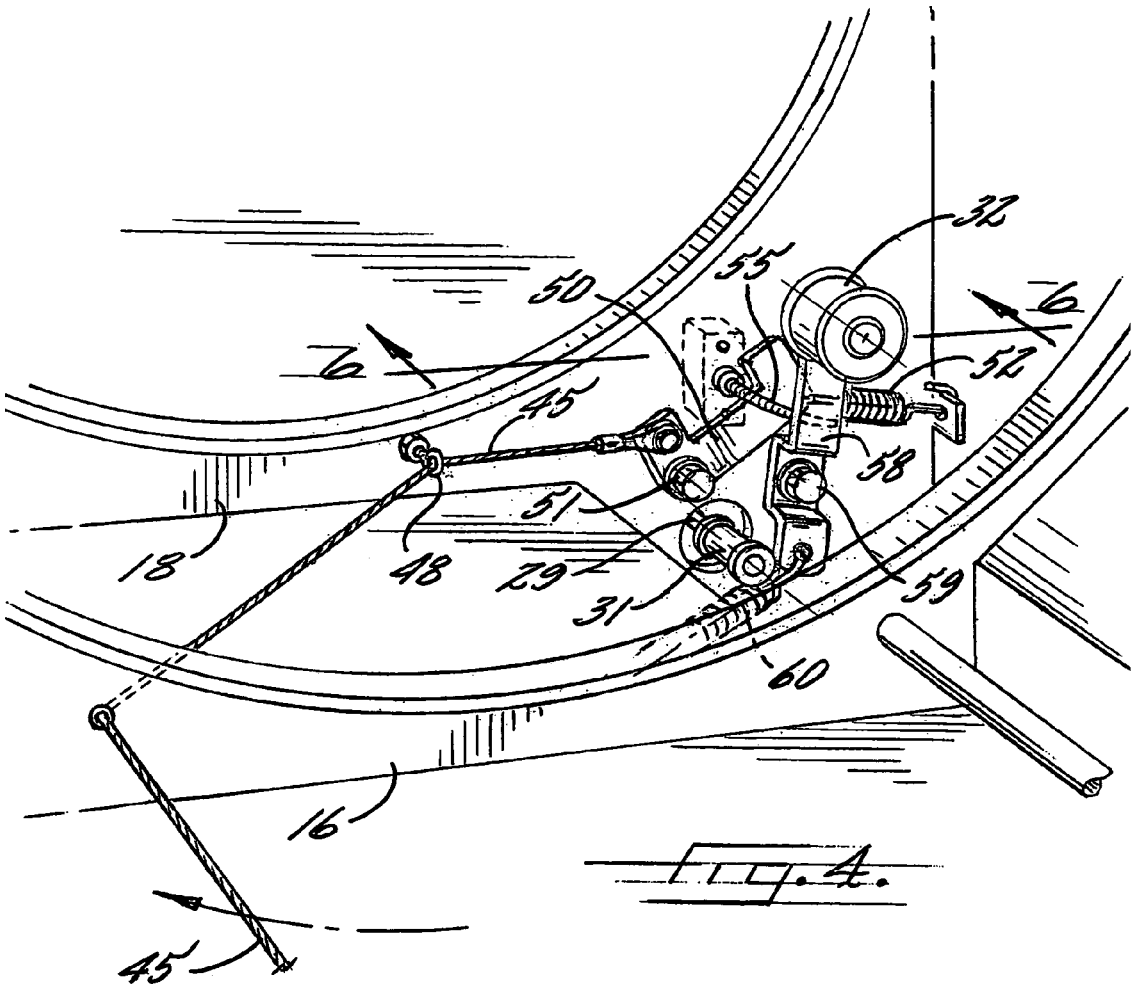
FIG. 4 is an enlarged fragmentary perspective taken in the plane of line 4—4 in FIG. 3; depicting the malfunction detection system of the present invention, with certain parts removed and oriented for clarity of illustration.
Figure 6:
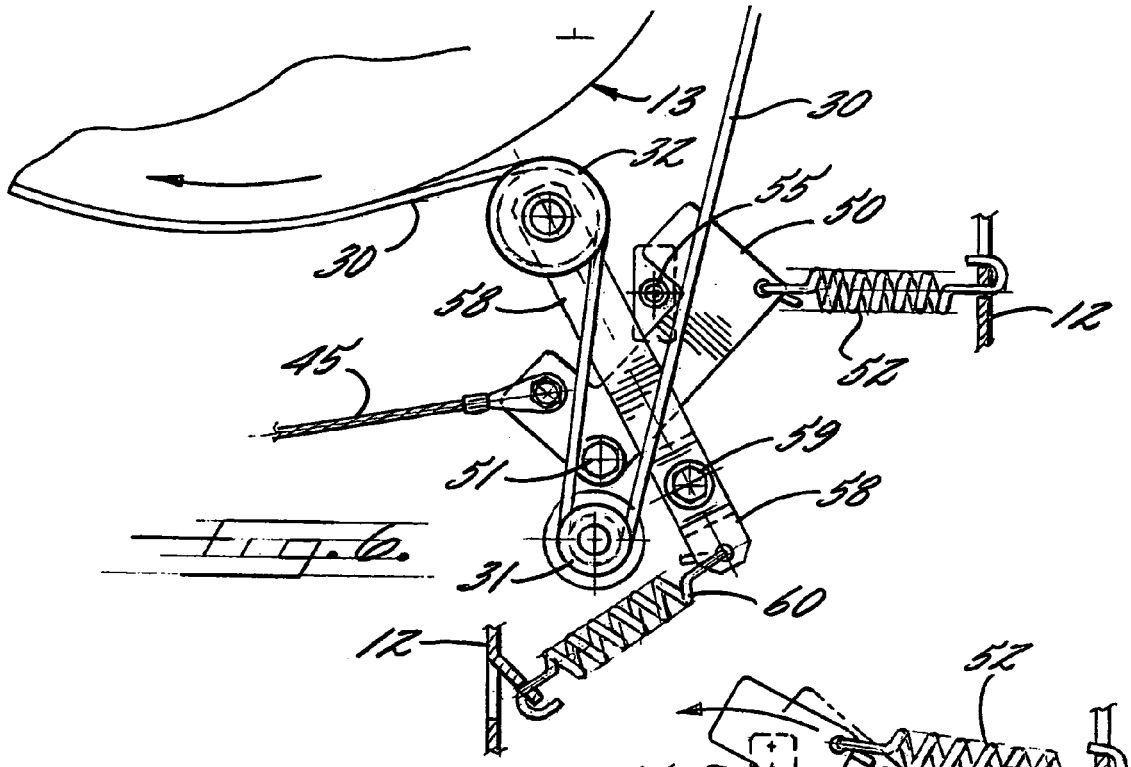
FIG. 6 is enlarged fragmentary depiction of the obstruction detection and drive belt malfunction detection systems in their passive conditions during normal operation of the tumbler dryer.
Figure 7:
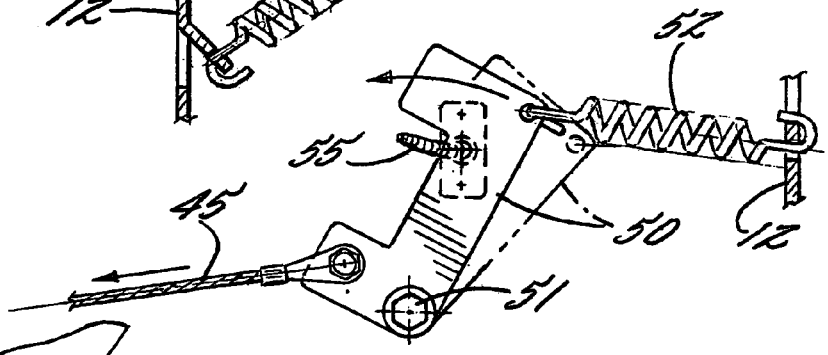
FIG. 7 is a perspective of the illustrated obstruction detecting system being moved to an actuated position in response to detection of an obstruction in movement of the tumbler basket.

In carrying out the invention, the cable 45 is operable for activating a dryer shutdown switch in response to being engaged by an obstructing item and immediately shut down operation of the laundry machine. In this instance, the cable 45 is fixed to the roller support bracket 26 at a front end of the dryer, is trained through an opening in the center partition 16, and then through an eye bolt 48 fixed to the rear panel 18 so that a rear end portion of the cable extends parallel to the rear panel 18 to a location at which it is fixed to a switch actuating pivot member 50 mounted for pivotal movement about a pin 51 fixed to the rear dryer panel 18. The pivot member 50 in this case has a general C shape with the pivot point being at one corner, the cable 45 being connected to another corner of the member 50, and a tension spring 52 being connected to a corner of the pivot member 50 diametrically opposed from the cable connection. The tension spring 52 is connected between the pivot member 50 and the cabinet 12 for biasing the pivot member 50 to a passive neutral position, as shown in FIGS. 4 and 6. It will be seen that as a consequence of an obstructing item 40 engaging the cable 45, continued rotation of the tumbler basket 13 in the clockwise direction, as viewed in FIG. 4, will move that portion of the cable 45 adjacent the perforated portion 21 of the basket 13 along with the basket, in turn causing the cable 45 to exert a pulling force on the pivot member 50 for rotating the pivot member about the pivot pin 51 against the biasing force of the tension spring 52, as shown in FIG. 7.

Figure 9:
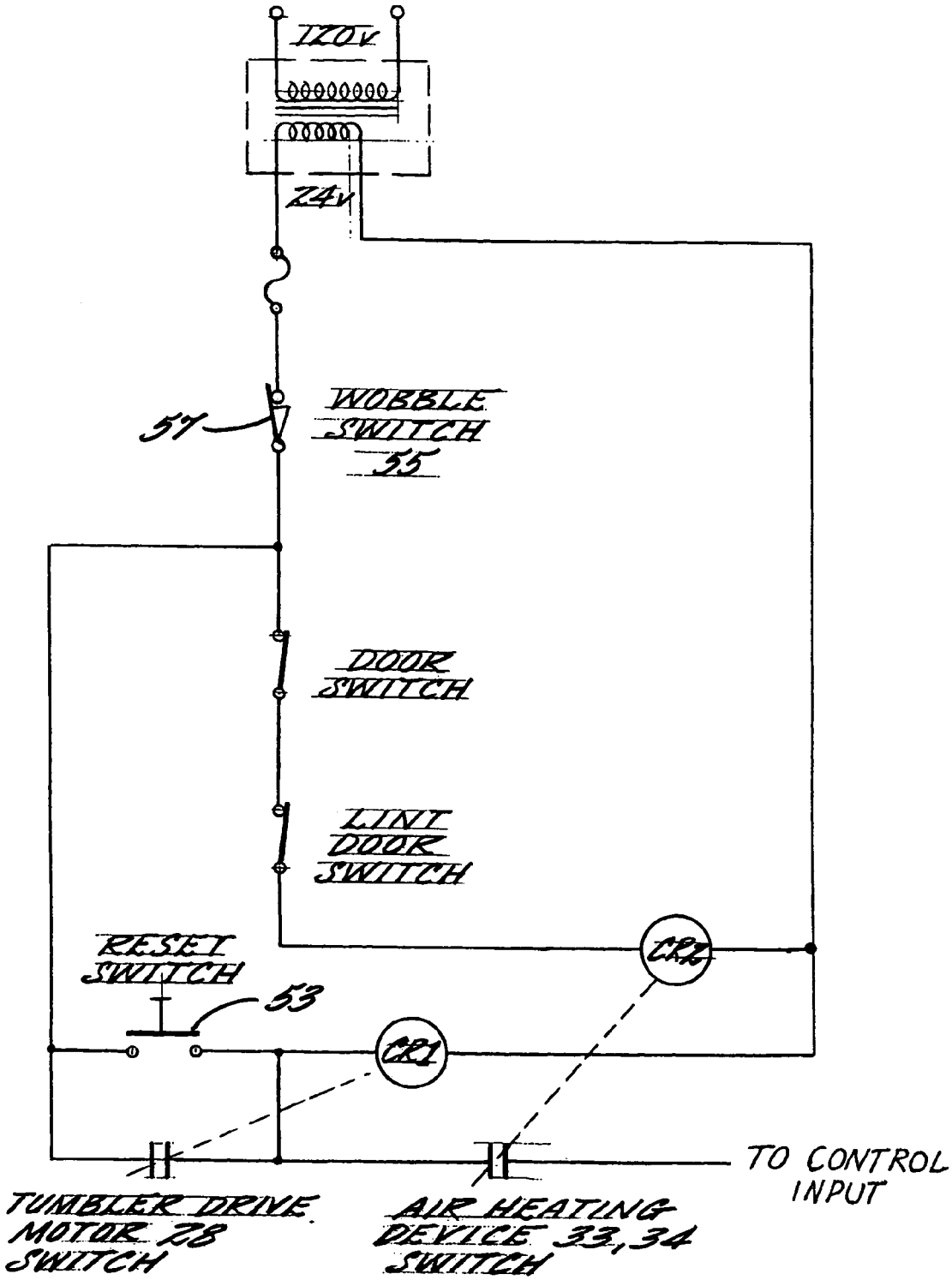
FIG. 9 is a diagrammatic depiction of control circuitry for the illustrated dryer.

In further carrying out the invention, a switch 55 is provided which is engageable by pivotal movement of the pivot member 50 in response to an obstructing item engaging and moving the cable 45, which is operable for immediately shutting down operation of the dryer. The switch 55 in this case is a conventional flexible wobble switch which is activated upon being deflected in any direction. It will be understood by one skilled in the art that the switch 55 may be integrated into control circuitry for the dryer such that upon activation, both power to the tumbler drive motor 28 is interrupted and power and/or fuel to the inlet air heating device 33 is terminated. In this instance, as shown in FIG. 9, the switch 55 actuates a normally closed contact 57 to interrupt power to the tumbler basket drive motor 28, fan 34, and heater 33. Since dryer shutdown is nearly immediate, damage to the interior of the dryer is prevented or substantially reduced. Moreover, the danger of a resulting fire from the malfunction is prevented. Following such automatic shutdown, the operator can remove the obstruction 40, inspect the dryer to insure no damage has occurred, and restart the dryer through activation of an appropriate reset switch 53. Hence, the obstruction detecting cable and associated switch activating device effectively serves as an obstruction interlock that will immediately shut down the machine to prevent damage to the dryer and the danger of fire as a result of a potentially harmful obstruction extending out of the basket.

Figure 8:
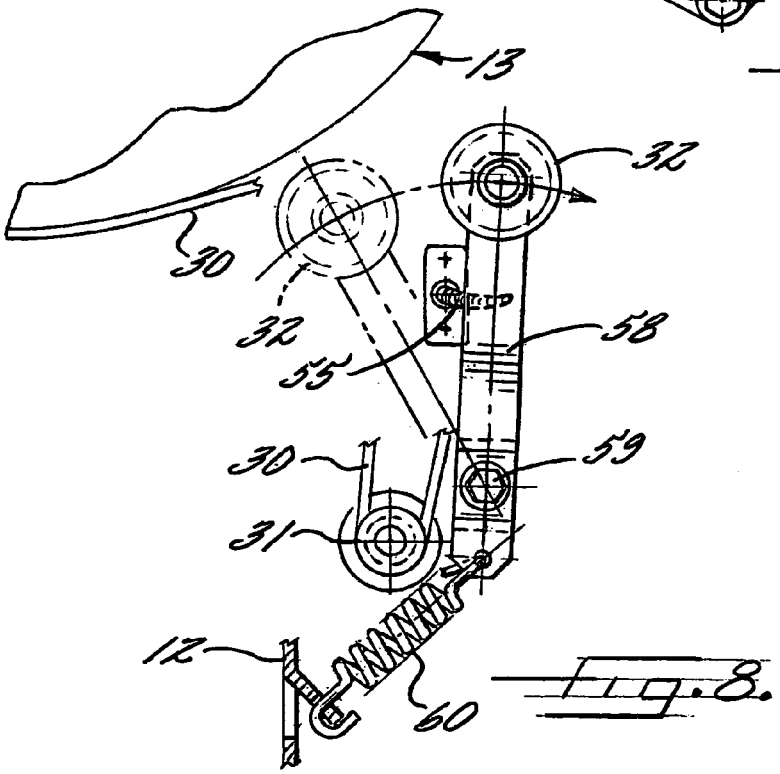
FIG. 8 is a fragmentary depiction of the drive belt malfunction detection device being moved to an actuated position in response to a broken or dislodged belt during operation of the machine.

In keeping with a further feature of the invention, a broken or dislodged drive belt malfunction detection system is provided for also shutting down the dryer in response to breakage or dislodgement of the drive belt 30 that would interrupt rotation of the tumbler basket 13. Again, the detection system operates in immediate response to the drive belt malfunction so as to shut down operation of the dryer prior to potential for overheating or ignition of items within the dryer. To this end, the idler pulley 32 is mounted on a switch actuating pivot member 58 supported for pivotal movement about a central pivot pin 59 fixed to the rear housing panel 18. For biasing the idler roller 32 in a belt tensioning direction, a tension spring 60 is connected between the dryer cabinet 12 and the end of the pivot member 58 opposite the end to which the pulley 32 is mounted. Hence, during normal operation of the dryer, the tension spring 60 biases the pivot member 58 in a clockwise, belt tensioning direction, as viewed in FIG. 6. In the event of breakage or dislodgement of the drive belt from the idler pulley 32 or drive pulley 31, tension of the drive belt 30 will be relieved and the tension spring 60 will pivot the pivot member 58 in a clockwise direction, as viewed in FIGS. 4 and 8, into engagement with the wobble switch 55 located adjacent the end of the idler roller carrying end of the pivot member 58. Activation of the wobble switch 55, whether by the obstruction detection pivot member 50 or the drive belt pivot malfunction pivot member 58, will immediately shut down operation of the dryer. Hence, the switch 55 serves a dual function of detecting both a broken or displaced drive belt, as well as an obstruction protruding from the basket. If either condition occurs, the switch 55 will be activated, shutting down the dryer and the heat source. Since a common sensing switch and shutdown circuitry may be utilized, the detection systems lend themselves to relatively economical design and manufacture. Moreover, it will be appreciated that other features may be included in the detection system, actuated by the common switch, such as illumination of one or more warning lights to bring to the attention of the tumbler dryer operator of the particular malfunction that has occurred.

From the foregoing, it can be seen that a laundry machine is provided which is adapted to detect multiple malfunctions, utilizing common sensing switches and circuitry, so as to protect the machine from damage and the existence of potentially dangerous conditions resulting from the malfunction. It will be appreciated by one skilled in the art that while the invention has been described in connection with a tumbler dryer, it may be used in connection with other laundry machines, including washing machines. As used herein, the term laundry machine is intended to encompass both washing machines and dryers.

What is claimed is:

1. A laundry machine comprising a cabinet, a tumbler for containing launderable items rotatably supported within said cabinet, a drive for rotating said tumbler during operation of said laundry machine, said tumbler having a perforated outer cylindrical wall portion, an obstruction detection element disposed in predetermined spaced relation to the outer perimeter of said tumbler perforated wall portion which is engageable by an obstructing item that extends through a perforation in said tumbler outwardly of the tumbler more than the distance of the predetermined spacing of said obstruction detection element from said tumbler, and a control device responsive to engagement of the detection element by an obstructing item protruding from the tumbler for shutting down operation of the laundry machine.

2. The laundry machine of claim 1 in which said obstruction detection element is deflectable upon engagement by an obstructing item protruding outwardly from said rotating basket, and said control device is operable in response to deflection of said obstruction detection element.

3. The laundry machine of claim 1 in which said cabinet includes at least one internal wall panel adjacent the tumbler, said obstruction detection element being disposed a closer distance to the outer perimeter of said tumbler drum perforated portion than any cabinet wall panel of said laundry machine.

4. The laundry machine of claim 1 in which said obstruction detection element is disposed a distance less than 0.5 inches from the outer perimeter of the perforated tumbler wall portion.

5. The laundry machine of claim 1 in which said obstruction detection element is disposed a distance of about 0.25 inches from the outer perimeter of said perforated tumbler wall portion.

6. The laundry machine of claim 1 in which said obstruction detection element is a cable mounted within said cabinet in parallel relation to the perforated wall portion of said tumbler.

7. The laundry machine of claim 1 in which said control device is operable for shutting down operation of the drive to said tumbler in response to engagement of the detection element by an obstructing item.

8. The laundry machine of claim 1 in which said tumbler is a laundry dryer tumbler basket, a selectively operable inlet air heating device for heating air directed into said tumbler basket for drying launderable items within the tumbler basket during operation of said machine, and said control device is operable in response to engagement of the detection element by an obstructing item protruding outwardly from said perforated drum section for shutting down operation of said inlet air heating device.

9. A laundry dryer machine comprising a cabinet, a tumbler for containing launderable items rotatably supported within said cabinet into which heated air is directed, a selectively operable drive motor for rotating said tumbler, said tumbler having a perforated outer cylindrical wall portion, a selectively operable heating device for heating air directed into said dryer, an obstruction detection element supported in adjacent relation to an outer perimeter of the tumbler perforated wall portion, said obstruction detection element being engageable by an obstructing item lodged in a perforation of said perforated wall portion in outwardly protruding relation to the outer perimeter of said tumbler during rotation of the tumbler, and a control device operable in response to said obstruction detecting element being engaged by an obstructing item extending outwardly of said rotating drum for shutting down operation of said tumbler drive motor.

10. The laundry machine of claim 9 in which said control device is operable in response to said obstruction detecting element being engaged by an obstructing item extending outwardly of said rotating drum for shutting down operation of said heating device.

11. The laundry machine of claim 9 in which said obstruction detection element is a flexible cable disposed a predetermined distance from the outer perimeter of said tumbler perforated wall portion and being engageable by an obstructing item protruding outwardly of the outer perimeter of said perforated tumbler section beyond said predetermined distance, said cable being deformable upon engagement by an obstructing item, and said control being operable in response to deformation of said cable.

12. The laundry machine of claim 11 including a pivotal actuating member and a control switch, said cable being connected to said pivotal actuating member such that engagement and deformation of said cable by an obstructing item protruding from the perforated wall portion during rotation of said tumbler will effect pivotal movement of said actuating member into actuating engagement with said control switch.

13. The laundry machine of claim 12 in which including a spring for biasing said actuating member in a direction out of engagement with said control switch, and said cable being effective upon deformation by an obstructing item protruding outwardly of said perforated wall section for overcoming the biasing force of said spring and moving said actuating member into actuating engagement with said control switch.

14. A laundry dryer machine comprising a cabinet, a tumbler for containing launderable items rotatably supported within said cabinet into which heated air is directed, a selectively operable heating device for heating air directed into said tumbler, a selectively operable drive for rotating said tumbler, said drive including a drive belt and a plurality of pulleys about which said drive belt is trained, a control device including a switch, a non-resilient elongated switch actuating member supported for pivotal movement about a pivot axis disposed in fixed relation to said cabinet intermediate ends of the switch actuating member, one of said pulleys being mounted on said elongated switch actuating member on one side of said pivot axis, a spring connected to said elongated switch actuating member on a side of said pivot axis opposite that on which said one pulley is mounted for biasing said actuating member in a direction in which said one pulley tensions said drive belt, said spring being operable in response to breakage or dislodgment of the drive belt from one of said pulleys for pivoting said actuating member from a belt tensing position to a switch actuating position that engages and actuates said switch, and said control being operable in response to actuation of said switch for shutting down operation of said heating device.

15. A laundry machine comprising a cabinet, a tumbler for containing launderable items rotatably supported within said cabinet, a drive including a drive belt for rotating said tumbler during operation of said laundry machine, said tumbler having a perforated outer cylindrical wall portion, an obstruction detection element disposed in predetermined spaced relation to the outer perimeter of said tumbler perforated wall portion which is engageable by an obstructing item that extends through a perforation in said basket outwardly of the basket more than the distance of the predetermined spacing of said obstruction detection element from said tumbler, an obstruction detection control device operable in response to engagement of said obstruction detecting element by an obstructing item protruding outwardly of the periphery of the rotary tumbler perforated portion for shutting down operation of the laundry machine, and a belt malfunction control device operable in response to a reduction in tension in the belt beyond a predetermined amount for shutting down operation of the machine.

16. The laundry machine of claim 15 in which said control devices each being operable for actuating a common switch in response to actuation of the respective control device for shutting down operation of the laundry machine.

17. The laundry machine of claim 15 in which said obstruction detection control device includes an obstruction detection element disposed in predetermined spaced relation to the outer perimeter of said tumbler perforated wall portion which is engageable by an obstructing item that extends through a perforation in said perforated tumbler wall portion more than the distance of the spacing of said obstruction detection element, and said obstruction detection control device being operable in response to engagement of the detection element by an obstructing item during rotation of said tumbler for shutting down operation of the laundry machine.

18. The laundry machine of claim 15 in which said drive for rotating said tumbler includes a plurality of pulleys about which said drive belt is trained, at least one of said pulleys being mounted on a pivotal switch actuating member, said belt malfunction control device including a switch, said switch actuating member being moveable from an inactive position during operation of said laundry machine to a switch actuating position that engages and actuates said switch in response to breakage of the belt or dislodgement of the belt from one of said pulleys, and said belt malfunction control device being operable in response to actuation of said switch for shutting down operation of the machine.

* * * * *